US007637768B1

(12) United States Patent
Hsu

(10) Patent No.: US 7,637,768 B1
(45) Date of Patent: Dec. 29, 2009

(54) GUIDING STRUCTURE OF CONNECTOR

(75) Inventor: Yung-Chin Hsu, Taipei (TW)

(73) Assignee: Inventec Corporation, Taipei (TW)

( * ) Notice: Subject to any disclaimer, the term of this patent is extended or adjusted under 35 U.S.C. 154(b) by 0 days.

(21) Appl. No.: 12/211,646

(22) Filed: Sep. 16, 2008

(30) Foreign Application Priority Data

Aug. 20, 2008 (TW) ..... 97131822

(51) Int. Cl.
*H01R 13/629* (2006.01)

(52) U.S. Cl. ..... 439/377; 439/374

(58) Field of Classification Search ..... 439/374, 439/377, 542, 325; 361/679.32
See application file for complete search history.

(56) References Cited

U.S. PATENT DOCUMENTS 4,941,841 A * 7/1990 Darden et al. ..... 361/679.39
5,315,478 A * 5/1994 Cadwell et al. ..... 361/679.32
6,500,018 B1 * 12/2002 Pfaffenberger et al. ..... 439/325
7,384,299 B1 * 6/2008 Bridges et al. ..... 439/445
2004/0092151 A1 * 5/2004 Haager et al. ..... 439/374
2006/0189199 A1 * 8/2006 Lang et al. ..... 439/374
2008/0113547 A1 * 5/2008 Jing ..... 439/374

* cited by examiner

*Primary Examiner*—Hien Vu
(74) *Attorney, Agent, or Firm*—J.C. Patents

(57) ABSTRACT

A guiding structure of a connector includes a holder and an operating element. The holder has a board and at least one connector accommodating cavity. The board is adapted to extend from an inserting hole to a connector slot, and the connector accommodating cavity is disposed on the board. The operating element is slanted on the board and has a bending portion and a fixing portion. The bending portion abuts against the board and the fixing portion has a first fastening part extending toward a guideway, and the first fastening part is adapted to lock with a second fastening part on a predetermined position of the guideway.

9 Claims, 4 Drawing Sheets

GUIDING STRUCTURE OF CONNECTOR

CROSS-REFERENCE TO RELATED APPLICATION

This application claims the priority benefit of Taiwan application serial no. 97131822, filed on Aug. 20, 2008. The entirety of the above-mentioned patent application is hereby incorporated by reference herein and made a part of this specification.

BACKGROUND OF THE INVENTION

1. Field of the Invention

The present invention generally relates to a guiding structure, in particular, to a guiding structure of a connector.

2. Description of Related Art

Generally, according to application degree, computer host levels may be divided into personal computer hosts, server hosts, and super computers. For the personal computer host, usually one or two processors are used to process common enterprise administrative business or multimedia relevant information. If it intends to process other works with complicated operations or store a large amount of data, the server host is used in the industry. In response to the recent network demand, it is possible to select a server computer system having two to four processors, or even up to eight or sixteen processors. For the application of the ultra high operation performance, usually a supper computer having tens or even hundreds, thousands of serially connected processors is adopted.

Recently, the commonly used server host in the industry is mainly a stackable and serially connected rack mount computer host. In the design, the size of a main board in the computer host is greatly reduced, a CPU, a chipset, a memory, and a hard disk are respectively disposed, and then the computer host is guided by a slide rail, so as to be assembled in the rack, such that the space is saved and it is conveniently for replacement. Each server is substantially an independently operating and replaceable computer host. Recently, the server host has developed to a blade server which has a thin appearance, small occupied space, and low power consumption, and is easily managed.

In order to transmit signals, a plurality of connector slots is disposed on the main board of the transmit signal, such that it is conveniently for the main board to serially connect to another main board (or an adapting board), thereby increasing multiplexity of the server, and achieving the high operation performance.

However, the server case is usually flat cuboid, and the connector slots on the main board are disposed in a narrow space on the back side of the case, such that it is not easy to insert the connector, thus resulting in the inconvenience of inserting and extracting the connector. Therefore, during expanding, updating, maintaining, or replacing, operating personnel usually need to use special tools or disassemble the case. Therefore, it is a problem to be urgently solved how to make it convenient for the operating personnel to insert the connector in the connector slot in the case.

SUMMARY OF THE INVENTION

Accordingly, the present invention is directed to a guiding structure of a connector, which is convenient for operating personnel to insert and extract the connector without any special tools or disassembling a case.

As broadly embodied and described above, the present invention provides a guiding structure of a connector, which is adapted to guide at least one connector to a case along a guideway. The case has an inserting hole and a connector slot spaced from the inserting hole by a predetermined distance. The guiding structure includes a holder and an operating element. The holder has a board and at least one connector accommodating cavity, the board is adapted to extend from the inserting hole to the connector slot, and the connector accommodating cavity is disposed on the board. The operating element is slanted on the board and has a bending portion and a fixing portion, the bending portion abuts against the board, the fixing portion has a first fastening part extending toward the guideway, and the first fastening part is adapted to lock with a second fastening part on a predetermined position of the guideway.

In an embodiment of the present invention, the connector accommodating cavity has an accommodating chamber, the accommodating chamber has an inlet and an outlet, and the outlet faces the connector slot.

In an embodiment of the present invention, the connector accommodating cavity further has an embedding portion and a buckling portion, respectively located on two opposite sides of the accommodating chamber, the embedding portion is adapted to penetrate a groove of the board and is exposed on a bottom surface of the board, so as to fix the accommodating chamber on a top surface of the board, and the buckling portion fixes the connector in the accommodating chamber.

In an embodiment of the present invention, two opposite sides of the guideway has two guiding slots, and the board is adapted to be accommodated between the two guiding slots, in which a vertical section of each guiding slot is, for example, in a shape of.

In an embodiment of the present invention, two opposite sides of the board includes two edgefolds, and the bending portion and the fixing portion of the operating element are disposed in the board and the two folded edges. In addition, the two folded edges respectively have a slanting surface, such that the operating element is in a slanting state.

In an embodiment of the present invention, the connector accommodating cavity is located on one end of the board, and the other end of the board has a handle portion.

In an embodiment of the present invention, the connector includes a cable connector.

In an embodiment of the present invention, the connector includes a power source connector.

The guiding structure of the connector of the present invention has a lengthened board, such that it is convenient to guide the connector to a predetermined position in the case with the board. Therefore, through the guiding structure of the present invention, the connector is made to abut against and electrically connect to the connector slot without any special tools or disassembling the case, such that it is convenient for the operating personnel to insert and extract the connector.

In order to have a further understanding of above features and efficacies of the present invention, a detailed description is given below with embodiments and accompanying drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
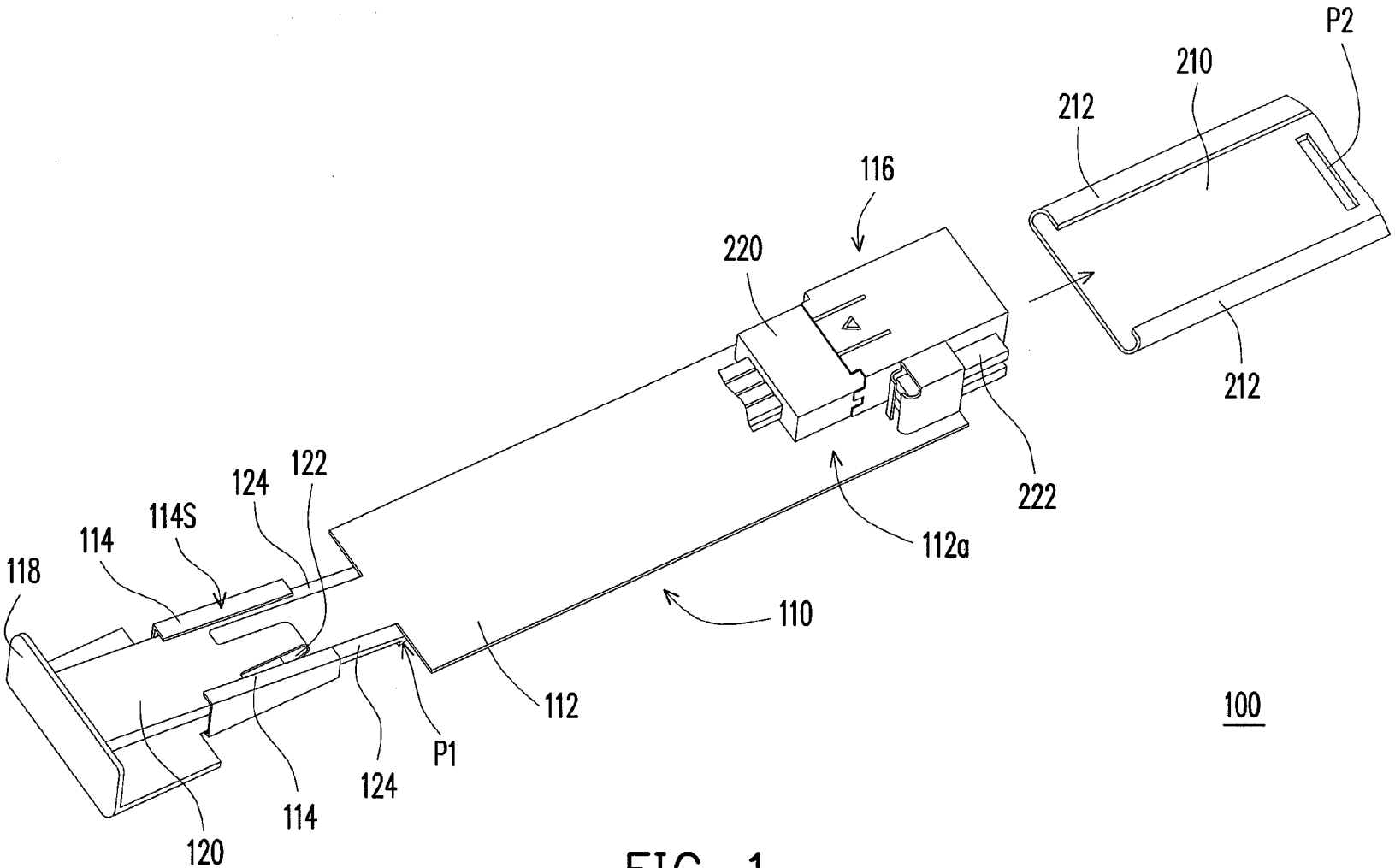
FIG. 1 is a schematic view of a guiding structure of a connector according to an embodiment of the present invention.

Reference will now be made in detail to the present embodiments of the invention, examples of which are illustrated in the accompanying drawings. Wherever possible, the same reference numbers are used in the drawings and the description to refer to the same or like parts.

Figure 2:
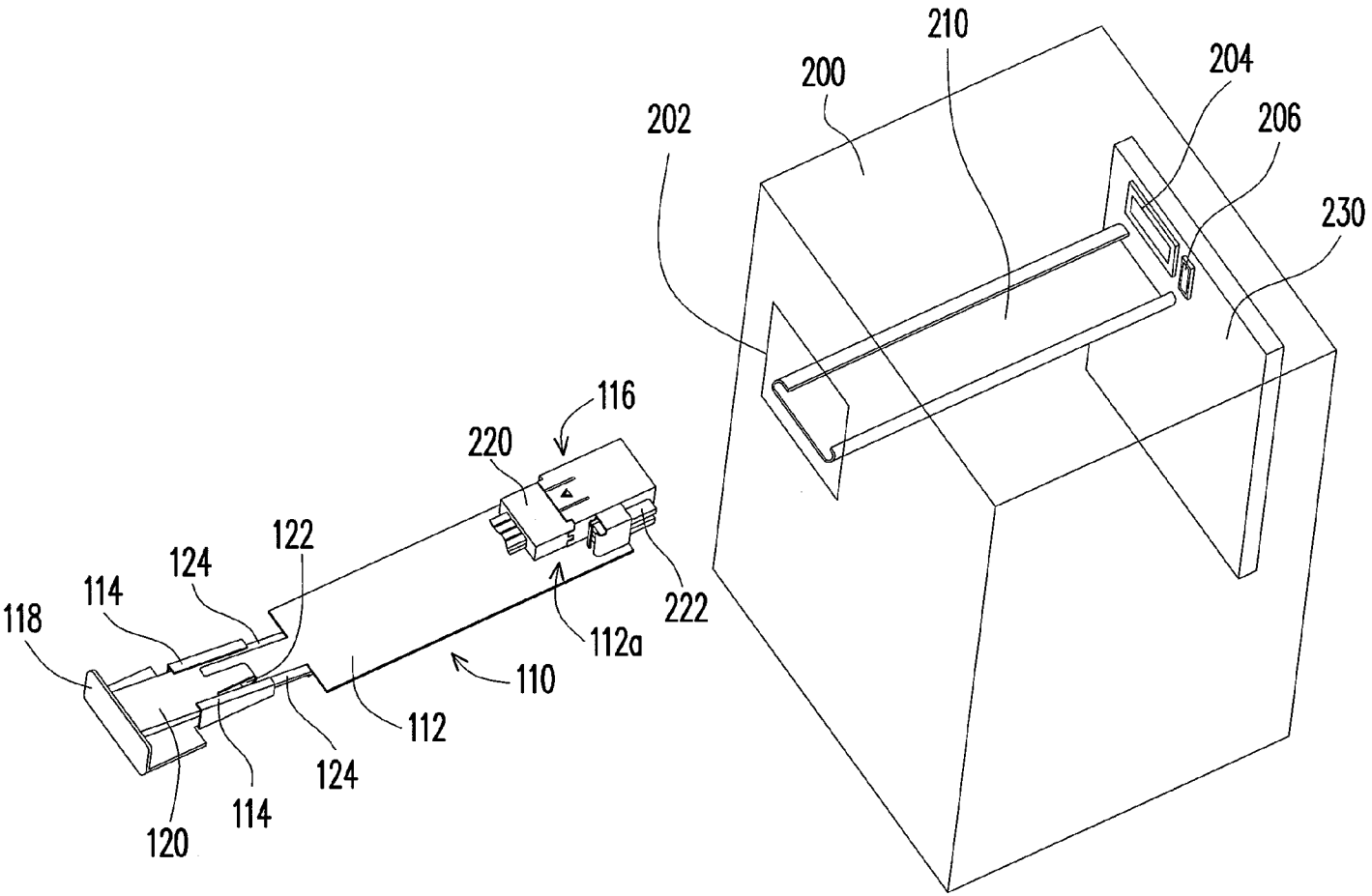
FIG. 2 is a schematic view of inserting the guiding structure of the connector of FIG. 1 to a case.

FIG. 1 is a schematic view of a guiding structure of a connector according to an embodiment of the present invention, and FIG. 2 is a schematic view of inserting the guiding structure of the connector of FIG. 1 to a case.

Referring to FIG. 1, a guiding structure 100 of the connector includes a holder 110 and an operating element 120. The holder 110 has a board 112, two folded edges 114, and at least one connector accommodating cavity 116 (for example, two). The board 112 is, for example, elongated, such that the board 112 may be accommodated in a guideway 210, and move along guiding slots of the guideway 210. Particularly, in this embodiment, two opposite sides of the guideway 210 have, for example, two guiding slots 212, and a vertical section of the guiding slot is, for example, in a similar shape of C. The board 112 is accommodated between the two guiding slots 212, and move along a linear path.

Next, two folded edges 114 are located on two opposite sides of the board 112, and a vertical section of the folded edge is, for example, in a similar shape of C. Particularly, the two folded edges 114 each have a slanting surface 114*s*, such that the operating element 120 may be in a slanting state. When the operating element 120 is slanted on the board 112, the operating element 120 has a bending portion 122 and a fixing portion 124 relative to the two folded edges 114. The bending portion 122 is, for example, an elastic blade having a predetermined elastic force, for abutting against the board 112, and the bending portion 122 is pressed in the two folded edges 114 of the board 112 in a normal state, such that the operating element 120 is normally kept on the position as shown in FIG. 1 through the elastic force. In addition, the fixing portion 124 is, for example, a board part located on left and right sides of the bending portion 122, extends from an upper part of the board 112 to a lower part of the board 112, and has a first fastening part P1 extending toward the guideway 210. Under a fastening state (not shown), the first fastening part P1 (for example, a hook) may lock with the a second fastening part P2 (for example, a slot) on a predetermined position of the guideway 210, so as to fix the guiding structure 100 of the connector on the guideway 210, thereby preventing loosing. When the user intends to disassemble the guiding structure of the connector 100, the user only needs to apply a force downwards on the operating element 120 to neutralize the elastic force of the bending portion 122, and the fixing portion 124 will move upwards relative to the board 112, such that the first fastening part P1 is separated from the second fastening part P2. At this time, when the user holds a handle portion 118 on the end of the board 112 to pull backwards, the guiding structure of the connector 100 may be moved out of the guideway 210 through the above operation.

In other not shown embodiments, the operating element 120 is not limited to be disposed on the board 112 in the above manner, and the relative position of the bending portion 122 and the fixing portion 124 of the operating element 120 is not limited to the above manner. At the same time, in an embodiment of the present invention, the hook of the operating element 120 locks with the slot of the guideway 210, and it is not used to limit the present invention. In other embodiments, the operating element 120 may be lock with the guideway 210 by using different fastening structures. In addition, in the not shown embodiments, the operating element 120 is not limited to use the two folded edges 114 as a stopping portion of elastic deformation, and it is also possible to limit the position of the operating element 120 by using other stopping structure, for example, a hole (not shown) is formed on the handle portion 118, so as to place an end portion of the operating element 120 and limit the position of the operating element.

Next, referring to the connector accommodating cavity 116 and connectors 220 and 222 of FIGS. 1 and 2, the connectors 220 and 222 are, for example, a cable connector and a power source connector each having a plurality of signal lines, for respectively connecting signals and power sources among different elements and circuit boards. The cable connector includes, for example, a USB interface connector, an IEEE1394 interface connector, an IDE interface connector, and an SATA interface connector etc. In this embodiment, the connector accommodating cavity 116 is disposed on one end (front end) of the board 112, such that the connectors 220 and 222 are guided to predetermined positions in the case 200 with the board 112, and it is convenient for the user to assemble the connectors 220 and 222. As shown in FIG. 2, when the board 112 enters the case 200 through an inserting hole 202 of the case 200, the front end of the board 112 extends toward connector slots 204 and 206 (for example, fixed on a circuit board 230, and spaced from the inserting hole 202 by a predetermined distance), such that ports of the connectors 220 and 222 are corresponding to the connector slots 204 and 206, so as to be connected to each other, thereby transmitting the signals or the power sources.

Figure 3:
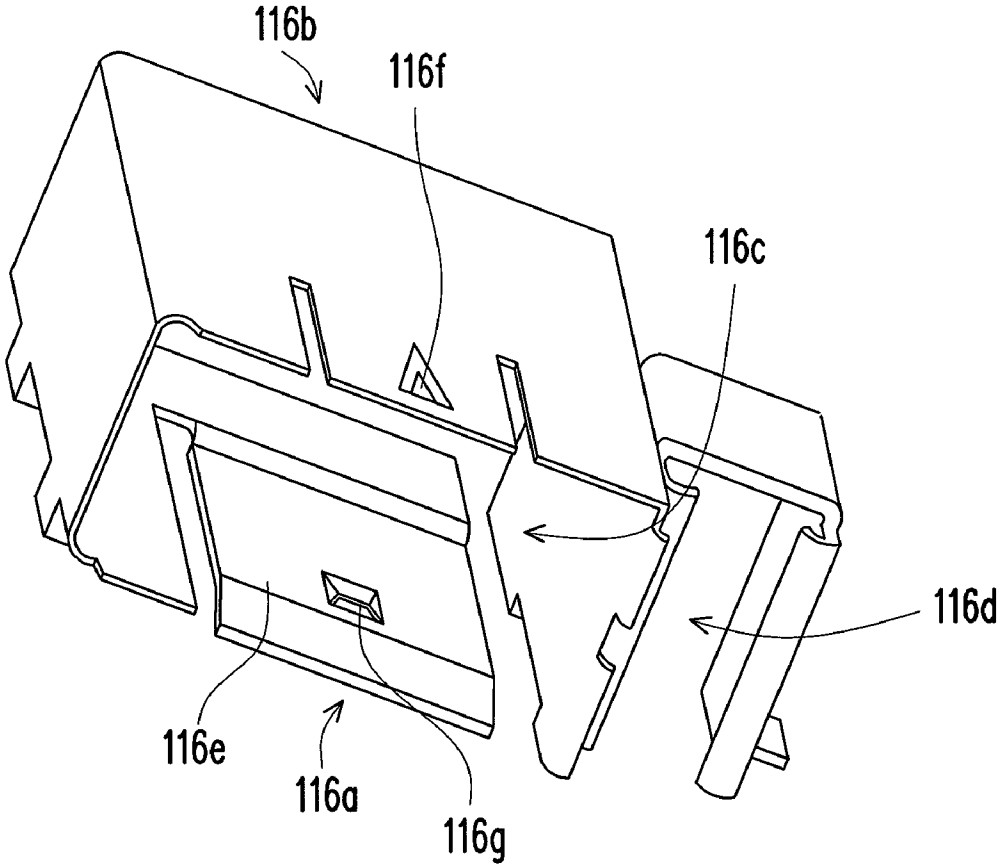
FIG. 3 is a schematic view of a connector accommodating cavity of FIG. 1.

FIG. 3 is a schematic view of the connector accommodating cavity of FIG. 1. Particularly, the connector accommodating cavity 116 has at least one accommodating chamber 116*c*, and the accommodating chamber 116*c* has, for example, an inlet 116*a* and an outlet 116*b*. When the connector 220 enters the accommodating chamber 116*c* through the inlet 116*a*, the port of the connector 220 is exposed in the outlet 116*b* and faces the direction of the connector slot 204. In this embodiment, the connector accommodating cavity has two accommodating chambers 116*c* and 116*d*, for respectively accommodating the connectors 220 and 222 with different functions, for example, the cable connector and the power source connector.

Figure 4:
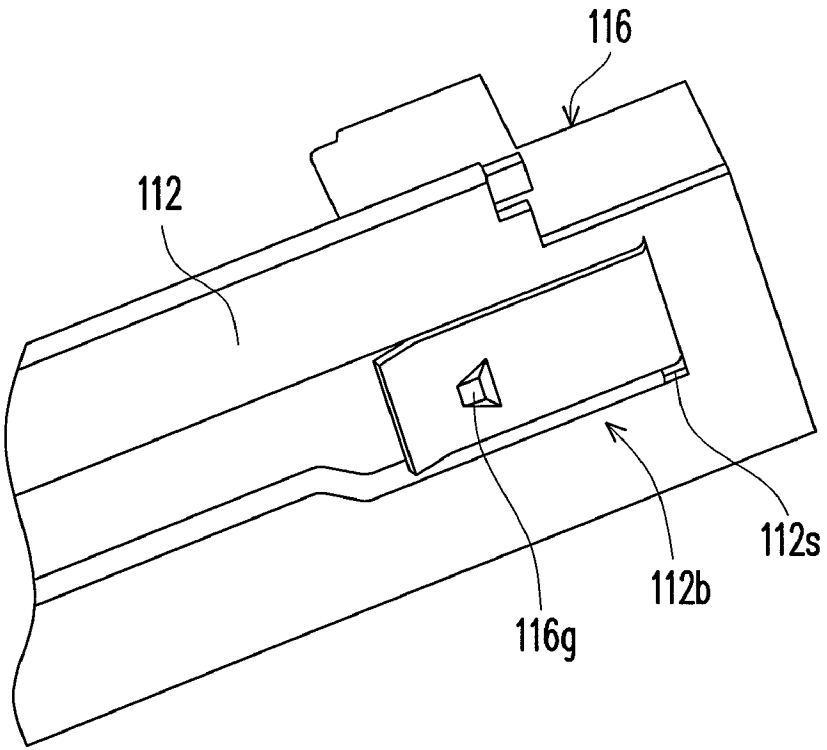
FIG. 4 is a schematic bottom view of a board and the connector accommodating cavity of FIG. 1.

Next, referring to FIGS. 1 and 3, in this embodiment, the connector accommodating cavity 116 has, for example, an embedding portion 116*e* and a buckling portion 116*f* (for example, hook), respectively located on two opposite sides of the accommodating chamber 116*c*. Therefore, when the connector 220 enters the accommodating chamber 116*c*, the buckling portion 116*f* may fix the connector 220 in the accommodating chamber 116*c*, such that it is not easy to result in shaking or falling. In addition, FIG. 4 is a schematic bottom view of the board and the connector accommodating cavity of FIG. 1. In FIG. 4, the embedding portion 116*e* is adapted to penetrate a groove 112*s* of the board 112 and is exposed on a bottom surface 112*b* of the board 112, and a hook 116*g* locks with a slot of the bottom surface 112*b*, so as to fix the connector accommodating cavity 116 on a top surface 112*a* of the board 112. Therefore, the connector accommodating cavity 116 and the board 112 may be combined as a whole by simply operating the embedding portion 116*e*, and during the assembling and the disassembling processes, tools is not required for locking or unlocking, thereby achieving a tool-free operation.

To sum up, the guiding structure of the connector of the present invention has a lengthened board, such that it is convenient to guide the connector to a predetermined position in the case with the board. Therefore, in the narrow space of the case of the server, the serial connection of the main board to another main board (or an adapting board) may be achieved through the guiding structure of the present invention, the connector is made to abut against and electrically connect to the connector slot without any special tools or disassembling the case, such that it is convenient for the operating personnel to insert and extract the connector.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A guiding structure of a connector, adapted to guide at least one connector to a case along a guideway, wherein the case comprises an inserting hole and a connector slot spaced from the inserting hole by a predetermined distance, the guiding structure comprising:

a holder, comprising a board and at least one connector accommodating cavity, wherein the board is adapted to extend from the inserting hole to the connector slot, and the connector accommodating cavity is disposed on the board; and an operating element, slanted on the board and comprising a bending portion and a fixing portion, wherein the bending portion abuts against the board, the fixing portion comprises a first fastening part extending toward the guideway, and the first fastening part is adapted to lock with a second fastening part on a predetermined position of the guideway, wherein the connector accommodating cavity comprises an accommodating chamber, an embedding portion and a buckling portion, the embedding portion and the buckling portion are respectively located on two opposite sides of the accommodating chamber, the embedding portion is adapted to penetrate a groove of the board and is exposed on a bottom surface of the board, so as to fix the accommodating chamber on a top surface of the board, and the buckling portion fixes the connector in the accommodating chamber.

2. The guiding structure of a connector according to claim 1, wherein the accommodating chamber comprises an inlet and an outlet, and the outlet faces the connector slot.

3. The guiding structure of a connector according to claim 1, wherein two opposite sides of the guideway comprise two guiding slots, and the board is adapted to be accommodated between the two guiding slots.

4. The guiding structure of a connector according to claim 3, wherein a vertical section of each guiding slot is in a shape of C.

5. The guiding structure of a connector according to claim 1, wherein two opposite sides of the board comprises two folded edges, and the bending portion and the fixing portion of the operating element are disposed in the board and the two folded edges.

6. The guiding structure of a connector according to claim 5, wherein the two folded edges respectively have a slanting surface, such that the operating element is in a slanting state.

7. The guiding structure of a connector according to claim 1, wherein the connector accommodating cavity is located on one end of the board, and the other end of the board comprises a handle portion.

8. The guiding structure of a connector according to claim 1, wherein the connector comprises a cable connector.

9. The guiding structure of a connector according to claim 1, wherein the connector comprises a power source connector.

* * * * *